US007374109B2

(12) United States Patent
Ellerhorst

(10) Patent No.: US 7,374,109 B2
(45) Date of Patent: May 20, 2008

(54) RAIL CUSHION ASSEMBLY

(75) Inventor: Gregg A. Ellerhorst, Cincinnati, OH (US)

(73) Assignee: Crown Plastics Company, Harrison, OH (US)

( * ) Notice: Subject to any disclaimer, the term of this patent is extended or adjusted under 35 U.S.C. 154(b) by 252 days.

(21) Appl. No.: 11/398,843

(22) Filed: Apr. 6, 2006

(65) Prior Publication Data

US 2007/0235551 A1 Oct. 11, 2007

(51) Int. Cl.
*E01B 9/00* (2006.01)

(52) U.S. Cl. ..... 238/283; 238/382

(58) Field of Classification Search ..... 238/264, 238/107, 283, 299, 306, 382, 287, 8
See application file for complete search history.

(56) References Cited

U.S. PATENT DOCUMENTS

| | | | | |
|---|---|---|---|---|
| 1,045,741 | A | 11/1912 | Pinney | 238/86 |
| 2,110,894 | A | 3/1938 | Stedman | 238/302 |
| 2,996,256 | A | 8/1961 | Moses | 238/283 |
| 3,945,566 | A | 3/1976 | Bush | 238/349 |
| 3,957,201 | A | 5/1976 | Johnson et al. | 238/298 |
| 4,047,663 | A | 9/1977 | Reynolds et al. | 238/304 |
| 4,231,908 | A | 11/1980 | Pennino | 524/71 |
| 4,316,578 | A | 2/1982 | Reynolds et al. | 238/283 |
| 4,527,736 | A | 7/1985 | Ortwein | 238/283 |
| 4,648,554 | A | 3/1987 | McQueen | 238/283 |
| 4,757,945 | A * | 7/1988 | Leeves | 238/107 |
| 4,771,944 | A | 9/1988 | Brister et al. | 238/283 |
| 4,899,933 | A | 2/1990 | Martin | 238/8 |
| 4,925,094 | A | 5/1990 | Buekett | 238/265 |
| 5,011,077 | A | 4/1991 | Hodgson et al. | 238/283 |
| 5,110,046 | A | 5/1992 | Young | 238/283 |
| 5,195,679 | A | 3/1993 | Leeves et al. | 238/283 |
| 5,203,502 | A | 4/1993 | Young | 238/283 |
| 5,261,599 | A | 11/1993 | Brown | 238/283 |
| 5,335,850 | A | 8/1994 | Igwemezie | 238/283 |
| 5,405,081 | A * | 4/1995 | Bosshart | 238/283 |
| 5,549,245 | A | 8/1996 | Kish | 238/283 |
| 5,551,632 | A | 9/1996 | Kish et al. | 238/283 |
| 5,551,633 | A | 9/1996 | Kish et al. | 238/283 |
| 5,730,357 | A | 3/1998 | Besenschek et al. | 238/283 |
| 6,045,052 | A | 4/2000 | Besenschek | 238/382 |
| 6,386,461 | B1 * | 5/2002 | Wildgoose | 238/283 |
| 6,471,139 | B1 | 10/2002 | Bruder et al. | 238/283 |
| 6,604,690 | B2 | 8/2003 | Young | 238/270 |
| 6,619,558 | B1 | 9/2003 | Jang | 238/283 |
| 6,761,322 | B1 | 7/2004 | Porrill et al. | 238/264 |
| 7,080,791 | B2 * | 7/2006 | Geissele et al. | 238/264 |

(Continued)

*Primary Examiner*—Mark Le
(74) *Attorney, Agent, or Firm*—Alfred J. Mangels

(57) ABSTRACT

A rail cushion assembly including a resilient rail pad for placement against the lower surface of a railroad rail, and an underlying abrasion plate for placement against a railroad tie. The rail pad includes a pair of slots that extend through opposite end sloping edge panels that are adjacent to the lower surface of the rail pad. The abrasion plate is a flat, sheet-like component that has a generally similar shape as that of the rail pad but includes a pair of outwardly-extending connection tabs, one at each of a pair of opposite edge surfaces. The connection tabs of the abrasion plate are received in respective slots of the rail pad to provide the rail cushion assembly in ready-to-use form and without requiring on-site assembly of the components.

12 Claims, 9 Drawing Sheets

U.S. PATENT DOCUMENTS 7,152,807 B2 * 12/2006 Nevins ..... 238/283
2004/0113133 A1 6/2004 Geissele et al. ..... 245/43
2004/0200906 A1 10/2004 Young ..... 238/264
2006/0151626 A1 * 7/2006 Geissele et al. ..... 238/29

* cited by examiner

RAIL CUSHION ASSEMBLY

BACKGROUND OF THE INVENTION

1. Field of the Invention

The present invention relates to an improved rail cushion assembly for use as a supporting cushion between a railroad rail and a railroad tie, especially a concrete railroad tie. More particularly, the present invention relates to an improved rail cushion assembly that includes a resilient rail pad that is in contact with the bottom flange surface of the railroad rail, and an abrasion-resistant plate that is positioned between the rail pad and a concrete railroad tie. The abrasion-resistant plate serves to minimize abrasion by sand and debris of the upper surface of the concrete railroad tie and of the lower surface of the rail pad as a result of movement of trains along the rail, thereby lengthening the useful operating life of the rail pad assembly.

2. Description of the Related Art

Anti-abrasion arrangements of various configurations have been proposed in the past for minimizing abrasion of the surfaces of concrete railroad ties and of the resilient pads that are placed between the railroad tie and the steel rail. It has been shown that two-part assemblies, consisting of a resilient pad positioned on an abrasion-resistant lower plate, have offered some relief to the problem of concrete tie abrasion at positions directly beneath the rails. One example of such a two-part system is illustrated and described in U.S. Pat. No. 5,405,081, entitled "Anti-Abrasion Rail Seat System," which issued on Apr. 11, 1995 to, John H. Bosshart.

The function of the abrasion plate in a two-part anti-abrasion system is to provide an abrasion-resistant, bearing-type surface between the resilient rail pad and the concrete tie surface. The resilient pad can then flex and shift along the surface of the abrasion plate, rather than flex and shift along the concrete tie surface, when it is subjected to the heavy and varying compressive loads that are imposed upon the rail pads by the weight of moving trains. Such heavy and varying compressive loading causes the resilient pad to be cyclically partially compressed vertically. And as a result of the vertical pressures applied to the pad, it is also spread or extended horizontally. Such horizontal spread of the pad material results in relative lateral movement between the resilient pad and the surface that it rests against. Without the presence of an intervening abrasion plate, the horizontal spreading of the pad, combined with the sand, grit, and debris generally present in such environments, provides the pad surface movement and resulting abrading action that causes the abrasion of the upper surface of the concrete tie, as well as of the abutting rail pad surface. As a result, the effective operating life of the rail pad and of the concrete tie is significantly reduced.

The presence of an abrasion plate that is positioned between the resilient rail pad and the concrete tie serves to prevent that periodic abrading action from taking place between the resilient rail pad lower surface and the upper surface of the concrete tie. Any relative rail pad movement or spreading resulting from pad flexing, or from any other applied load, is intended to take place between the resilient pad surface and the abrasion plate surface, and not between the resilient pad surface and the upper surface of the concrete tie. Testing has shown that concrete tie abrasion can be significantly diminished by positioning a highly wear resistant surface between the resilient rail pad and the upper surface of the concrete tie.

Experience has shown, however, that the same desirable bearing and abrasion resistance properties of currently utilized abrasion plate materials can also cause the abrasion plate to slide out from between the resilient rail pad and the tie, either longitudinally or laterally, when the combination is subjected to the cyclically-varying compressive loading described above. Thus, there is a need for improved resilient rail pad and abrasion plate designs and assemblies that permit the two components to be separately produced as physically independent parts, yet be effectively interconnected in such a way that the two components continue to work together as a system and to remain properly positioned on the tie, as well as relative to each other.

One proposal for an interconnected resilient rail pad and abrasion plate is disclosed in published patent application No. US 2004/0113133 A1, entitled "Abrasion Assembly for Supporting Railroad Ties," which was published on Jun. 17, 2004, and which names William Hugo Geissele et al. as inventors. That publication discloses a rail pad that includes a number of surface depressions formed on its lower surface, and an injection molded, thermoplastic polymer abrasion plate that includes a number of correspondingly-positioned surface protrusions that are formed on its upper, rail-pad-facing surface. The depressions and protrusions interengage with each other when the resilient pad and the abrasion plate are placed in face-to-face contact with each other, so that the protrusions are received in the depressions, to prevent substantial relative sliding movement and lateral separation between the rail pad and the abrasion plate.

Additionally, as a further interconnection arrangement, the structure disclosed by Geissele et al. includes a resilient rail pad having a hole at each of the four corners. The rail pad holes receive correspondingly-positioned, upstanding, molded stalks or pins that are carried at the corners of the molded thermoplastic abrasion plate and that extend through the rail pad holes when the pad and plate are placed together. The tips of the stalks or pins are deformed by the application of heat to cause the tips to mushroom and thereby non-removably retain the pad and plate together. The result is a two-part, interconnected and interengaged pad and plate assembly that serves to limit relative movement of the pad and plate, but that also provides the constraints to limit excessive and problematic pad and plate separation that could lead to tie surface contact of the pad and possible pad abrasion and tie abrasion.

The interconnection arrangement disclosed in the above-identified Geissele et al. published application requires the use of an injection-moldable grade of polymeric material to provide the necessary protrusions and pins of the disclosed abrasion plate design. Consequently, the use of high performance, non-injection-moldable grades of materials is necessarily excluded. For example, if ultra high molecular weight polyethylene (UHMWPE) were to be desired to be utilized as the abrasion plate material in the Geissele et al. arrangement, it would be disqualified because that material cannot be injection molded. That and other highly abrasion resistant, ultra high molecular weight materials typically exhibit zero melt flow when heated above their melt temperature, and therefore they can only be manufactured in flat profiles using high-pressure compression-molding processes. Complex, three-dimensional profiles of UHMW materials can only be achieved through costly, post-molding machining of thick sheets to provide the disclosed surface features, and thus such raw material options are economically foreclosed from consideration in designs such as the one proposed by Geissele et al. In addition to UHMW polyethylene, other high performance UHMW polymers (e.g., UHMW acetal or UHMW nylon) having superior abrasion-resistant performance properties would also be eliminated from consideration in the Geissele et al. arrangement.

Therefore, in order to utilize such superior, high-performance, longer-lasting materials as candidates in the manufacture of two-part rail pad assemblies, there is a need for a railroad pad assembly design that allows the use of a flat, two-dimensional abrasion plate. Such an assembly should also provide suitable constraints to keep the abrasion plate from shifting relative to the resilient pad by slipping out laterally when the assembly is exposed to the cyclic compressive loading normally encountered in a rail pad application. The present invention responds to that need.

SUMMARY OF THE INVENTION

Briefly stated, in accordance with one aspect of the present invention, an improved rail cushion assembly is provided for placement between a lower surface of a railroad rail and an upper surface of a railroad tie. The cushion assembly includes a resilient rail pad having a substantially flat upper surface adapted to face and to contact a railroad rail lower surface, and a substantially flat lower surface adapted to face a railroad tie upper surface. The rail pad includes a pair of railroad-tie-engaging, inclined opposite edges that extend from a pair of opposed end edge panels of the rail pad, and at least one slot is provided at each of the inclined edges of the rail pad; A flat, flexible abrasion plate is releaseably carried by the rail pad adjacent the lower surface of the rail pad. The abrasion plate includes at least one laterally-extending tab on each of two opposite edge surfaces. Each of the tabs is releaseably received in a respective slot of the rail pad to provide a unitary rail cushion assembly.

BRIEF DESCRIPTION OF THE DRAWINGS

The structure, operation, and advantages of the present invention will become further apparent upon consideration of the following description, taken in conjunction with the accompanying drawings in which.

DESCRIPTION OF THE PREFERRED EMBODIMENTS

Figure 1:
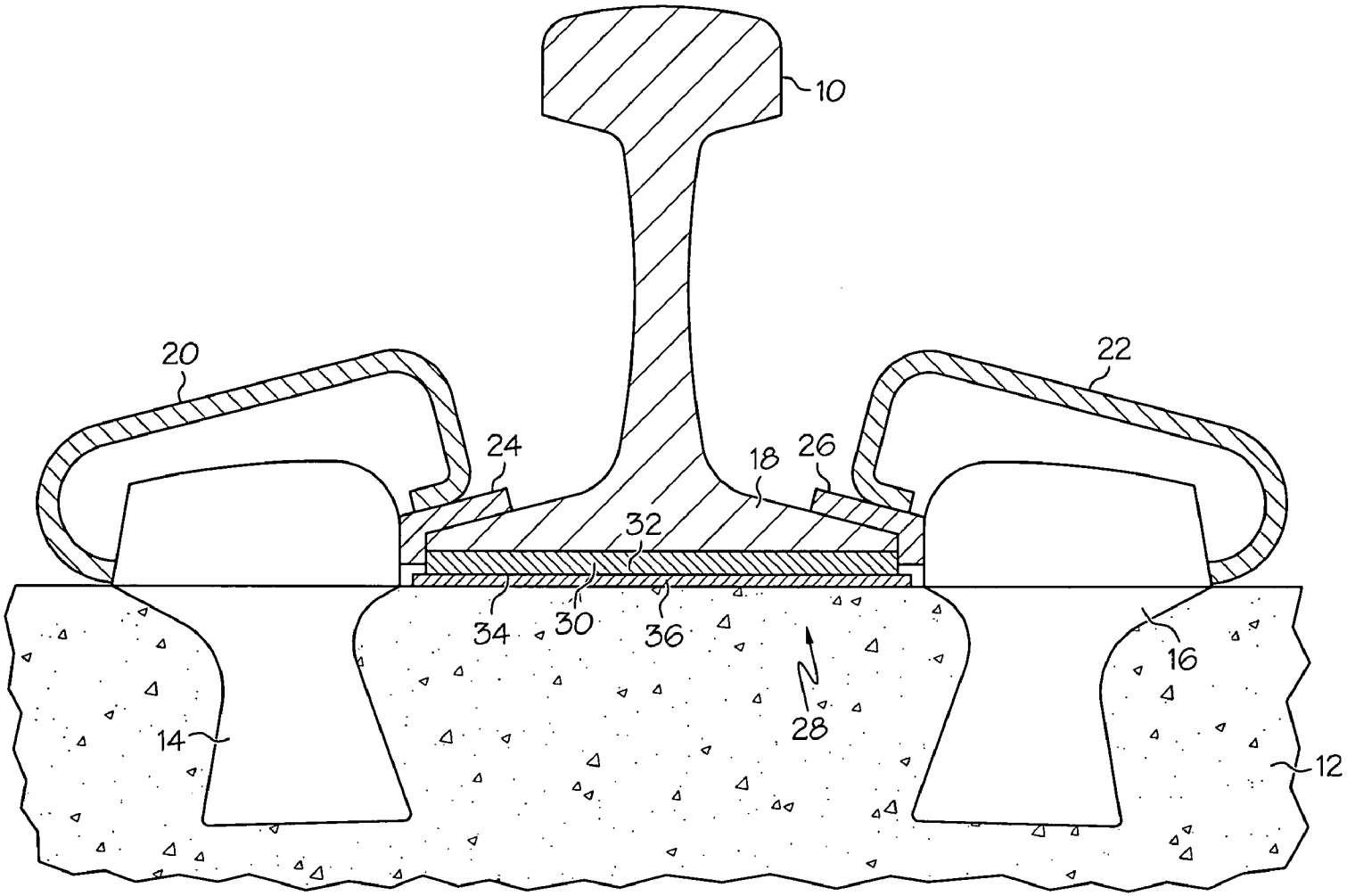
FIG. 1 is a cross-sectional view of a railroad rail and associated railroad tie including a rail pad assembly embodiment positioned between the rail and tie.

In order to assure that the descriptions of direction or of orientation of components as described in this application are clear and unambiguous, a directional reference will first be established. In that regard, any and all references to direction, such as "longitudinal," "lateral," and "transverse," will have as their reference point the longitudinal axis of the steel rail when it is positioned as shown in FIG. 1 for rail service. Thus, whenever the term "longitudinal" is used to identify a direction, it is to be understood, unless otherwise noted, that the intended direction is along or parallel to the longitudinal axis of the steel rail when it is installed for rail service as shown in FIG. 1. Similarly, whenever either of the terms "lateral" or "transverse" is used to identify a direction, it is to be understood, unless otherwise noted, that the intended direction is perpendicular to the longitudinal axis of the steel rail when it is installed for rail service as shown in FIG. 1.

Referring now to the drawings, and particularly to FIG. 1 thereof, there is shown a railroad rail 10 that is supported on the upper surface of a concrete railroad tie 12. Embedded in tie 12 is a pair of spaced rail support members 14, 16 defining the lateral space between which the base flange 18 of rail 10 is received. Support members 14, 16 each include a hold-down clamp arm 20, 22 that extends toward rail 10 to overlie end portions of base flange 18 of rail 10, to thereby serve to hold rail 10 and prevent its upward movement away from tie 12. An insulator 24, 26 is positioned between a respective clamp arm 20, 22 and an underlying end of base flange 18.

Figure 1A:
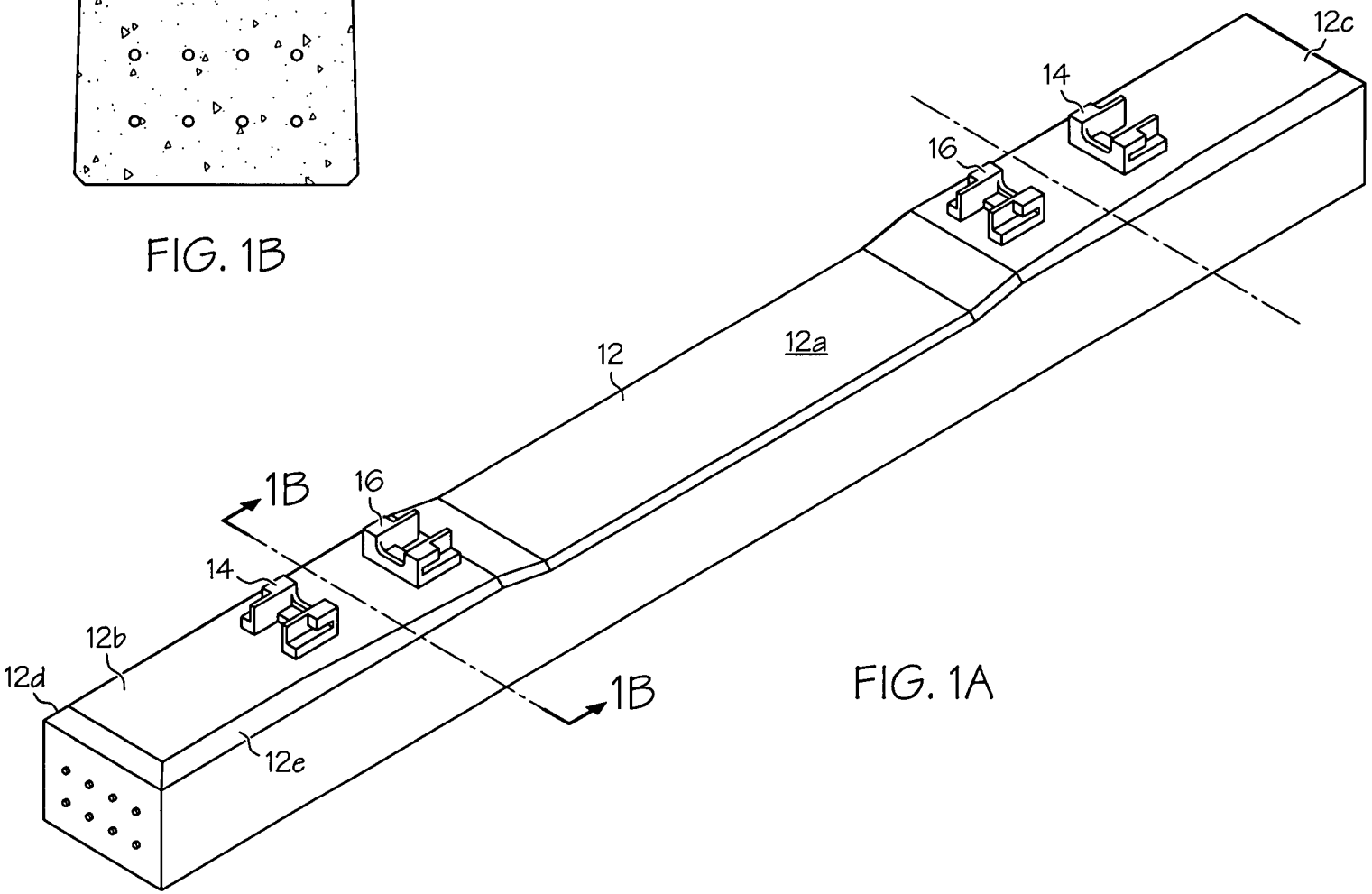
FIG. 1A is a perspective view of one form of concrete railroad tie.

A typical concrete railroad tie 12 is shown in a perspective view in FIG. 1A. Tie 12 is formed from concrete with a plurality of steel reinforcement bars, and it includes a recessed central portion 12*a* and end portions that includes respective planar upper surfaces 12*b* and 12*c*. Upper surfaces 12*b* and 12*c* are pitched slightly downward toward the center of the tie at an angle of approximately 1.5°, and are at an elevation higher than the recessed central portion 12*a*.

Figure 1B:
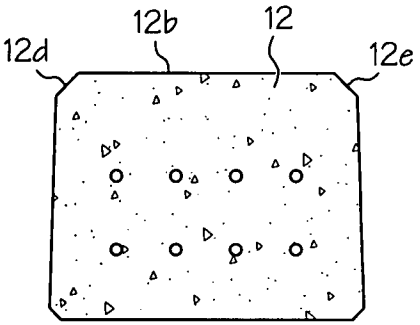
FIG. 1B is a cross-sectional view taken along the line 1B-1B of FIG. 1A.

The railroad rails are supported on the respective end portions of the tie and are positioned between rail support members 14, 16 at a location hereby referred to as the rail seat. A cushion assembly 28 as shown in FIG. 1 is placed between the steel rail and the underlying concrete tie. A cross-sectional view of the rail seat centerline taken along the line 1B-1B of FIG. 1A is shown in FIG. 1B, in which tie 12 is seen to have a generally rectangular cross section, with planar upper surface 12*b*. The outer edges of upper surface 12*b* are chamfered at 12*d* and 12*e* at a chamfer angle of about 45° relative to upper surface 12*b*. Similar chamfers are provided at upper surface 12*c*. Chamfers 12*d* and 12*e* are engaged by respective lower surfaces of downwardly sloping end edge panels of the proposed rail pad, an arrangement that prevents movement of rail pad 12 in a longitudinal direction relative to the steel rail, as will be explained hereinafter.

Because of changing downward vertical forces imposed upon concrete tie 12 through rail 10 by the weight of moving trains, a rail cushion assembly 28 is provided between rail 10 and tie 12. Cushion assembly 28 is positioned between the flat, bottom surface 30 of base flange 18 to absorb the cyclically-varying compressive forces transmitted through rail 10 that would otherwise act directly against concrete tie 12 and would gradually cause wear of the portion of the upper surface of the concrete tie 12 that lies below rail base flange 18. Rail cushion assembly 28 includes a substantially flat, resilient rail pad 32 that is in surface-to-surface contact with bottom surface 30 of rail 10. Positioned below and in surface-to-surface contact with bottom surface 34 of rail pad 32, and also in surface-to-surface contact with the upper surface of concrete tie 12 is an abrasion plate 36.

Figure 2:
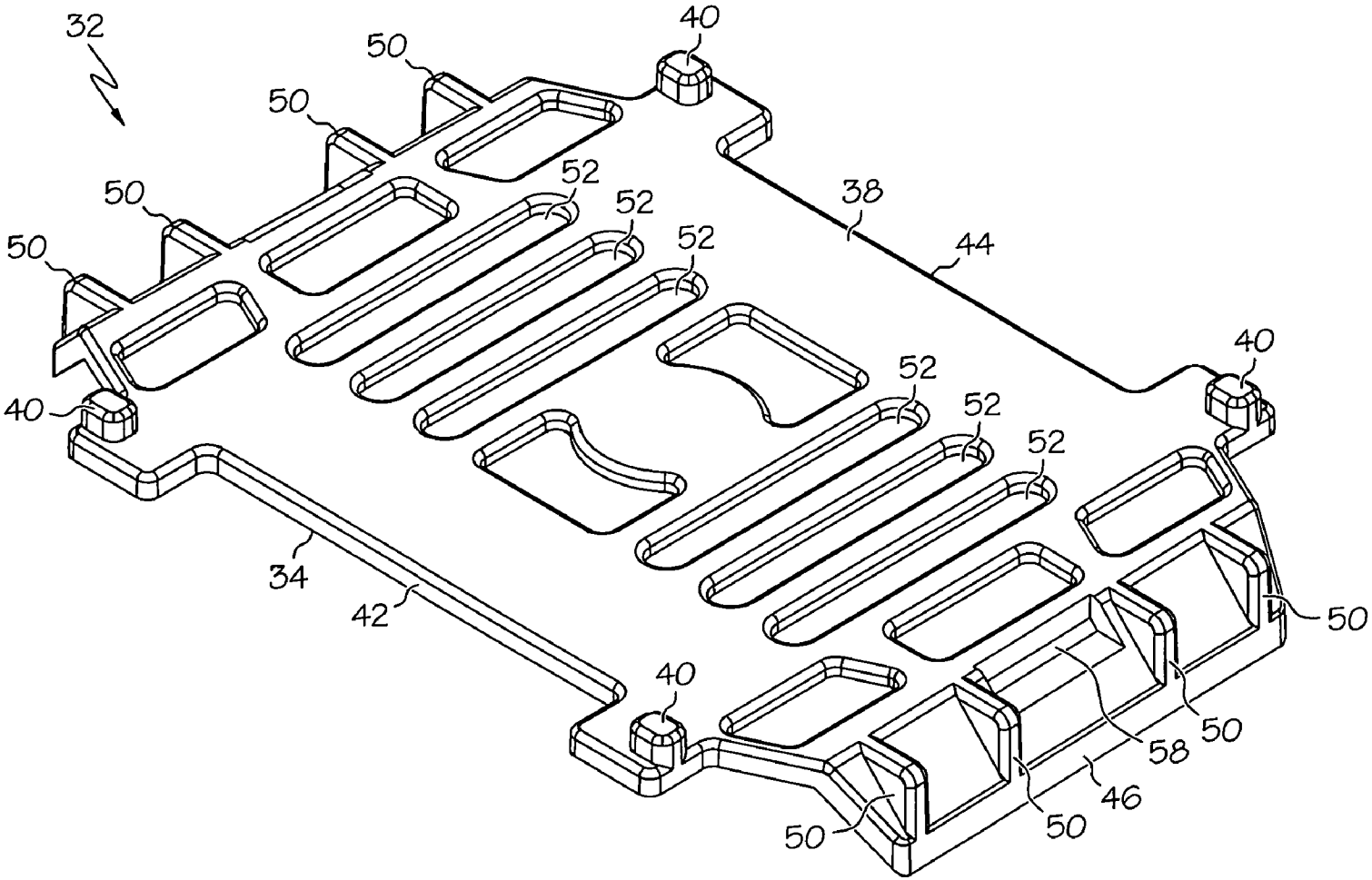
FIG. 2 is a top perspective view of the rail pad shown in FIG. 1.
Figure 3:
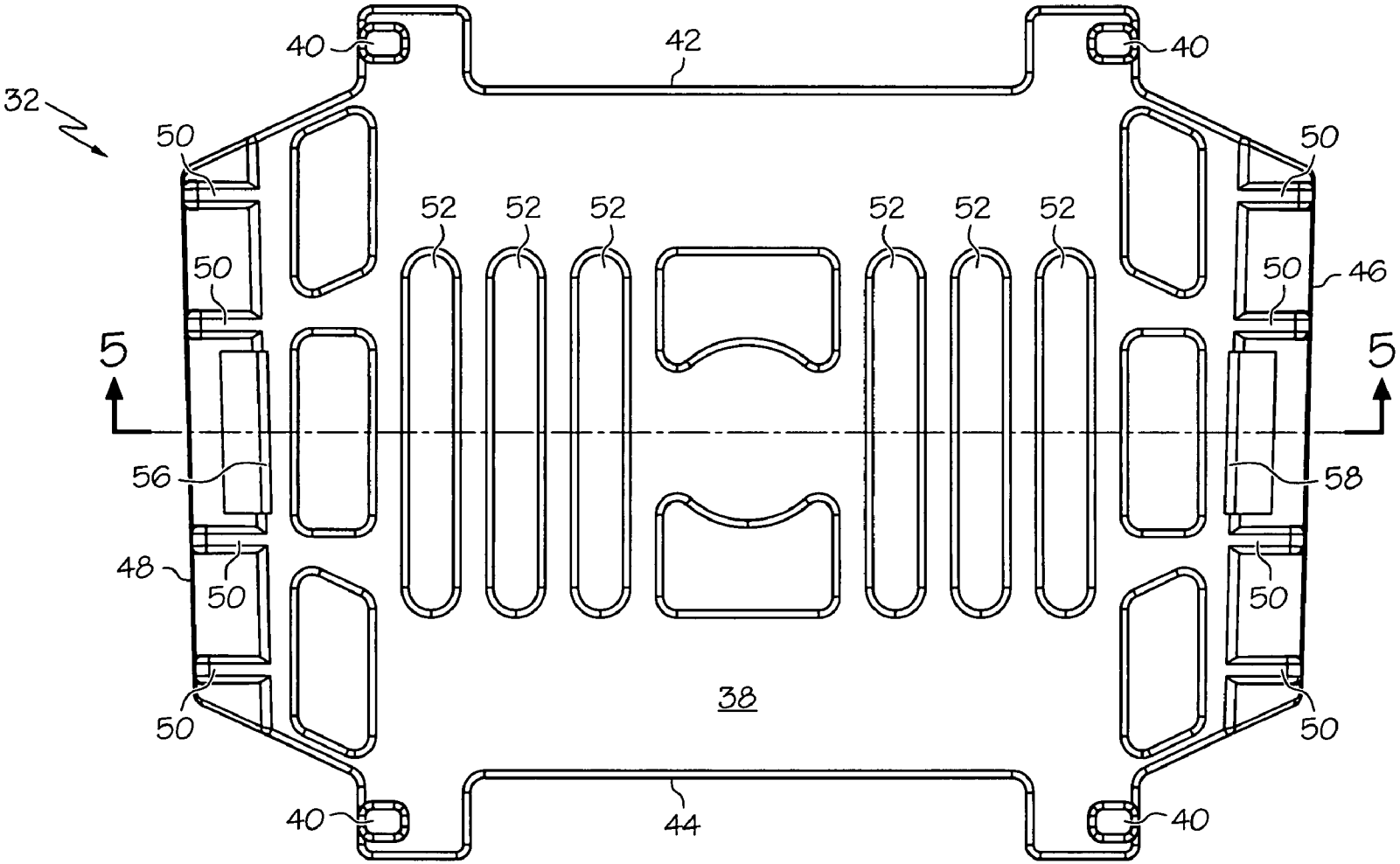
FIG. 3 is a top plan view of the rail pad.
Figure 4:
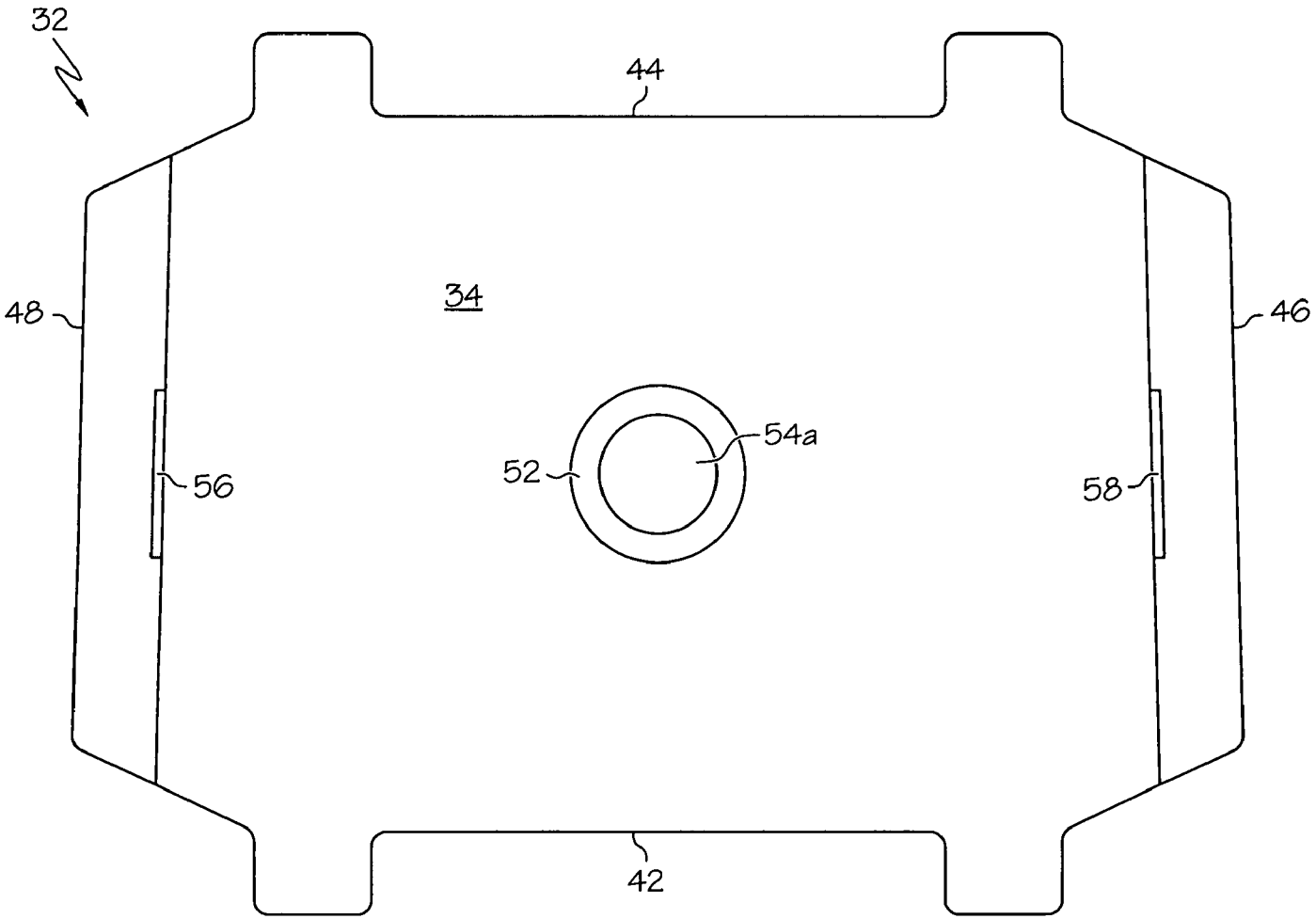
FIG. 4 is a bottom plan view of the rail pad.
Figure 5:
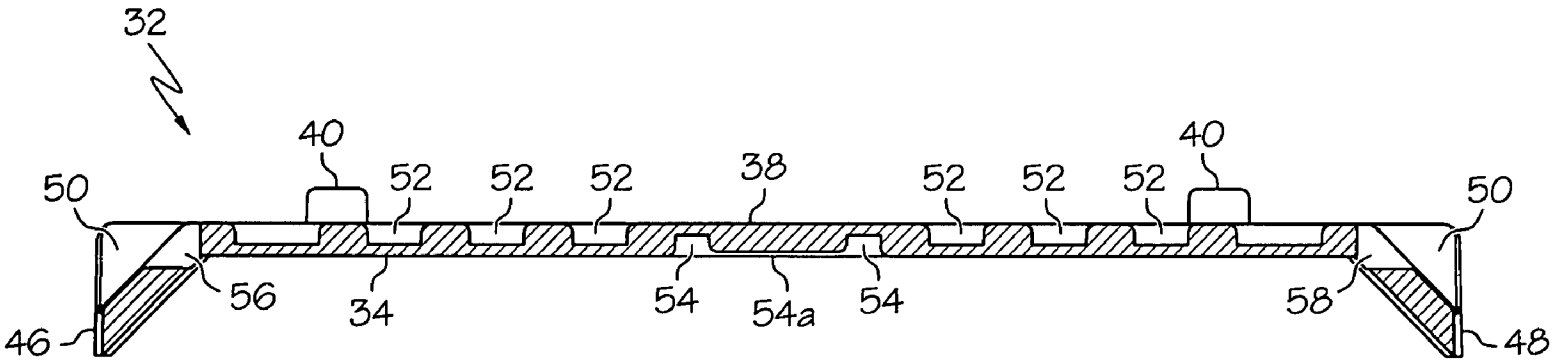
FIG. 5 is a cross-sectional view of the rail pad taken along the line 5-5 of FIG. 3.
Figure 6:
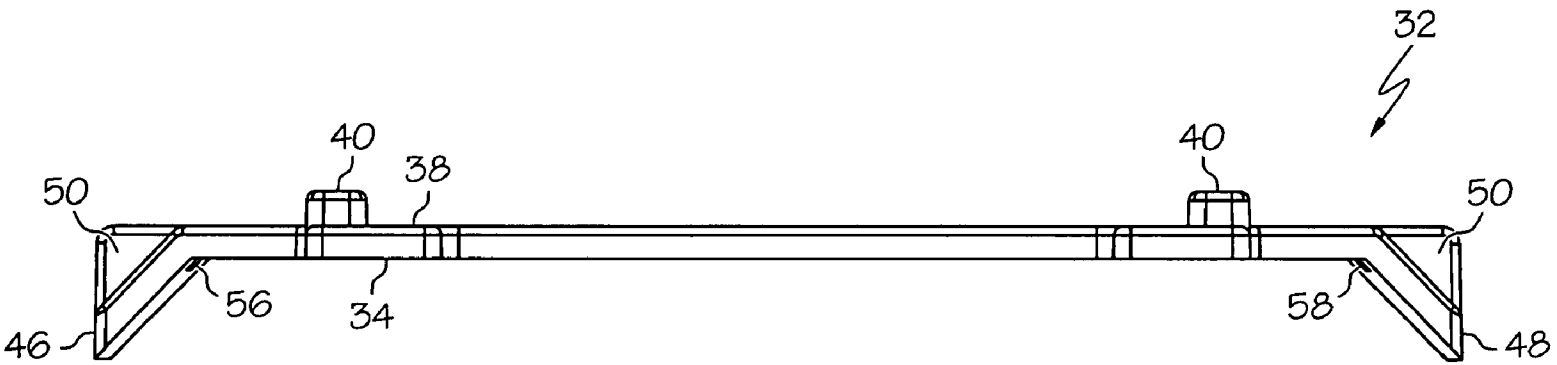
FIG. 6 is a side view of the rail pad.
Figure 7:
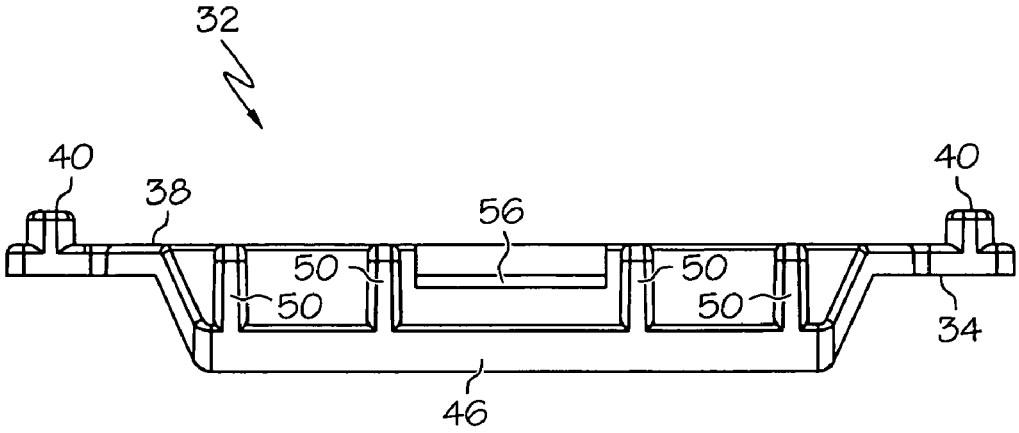
FIG. 7 is an end view of the rail pad.
Figure 8:
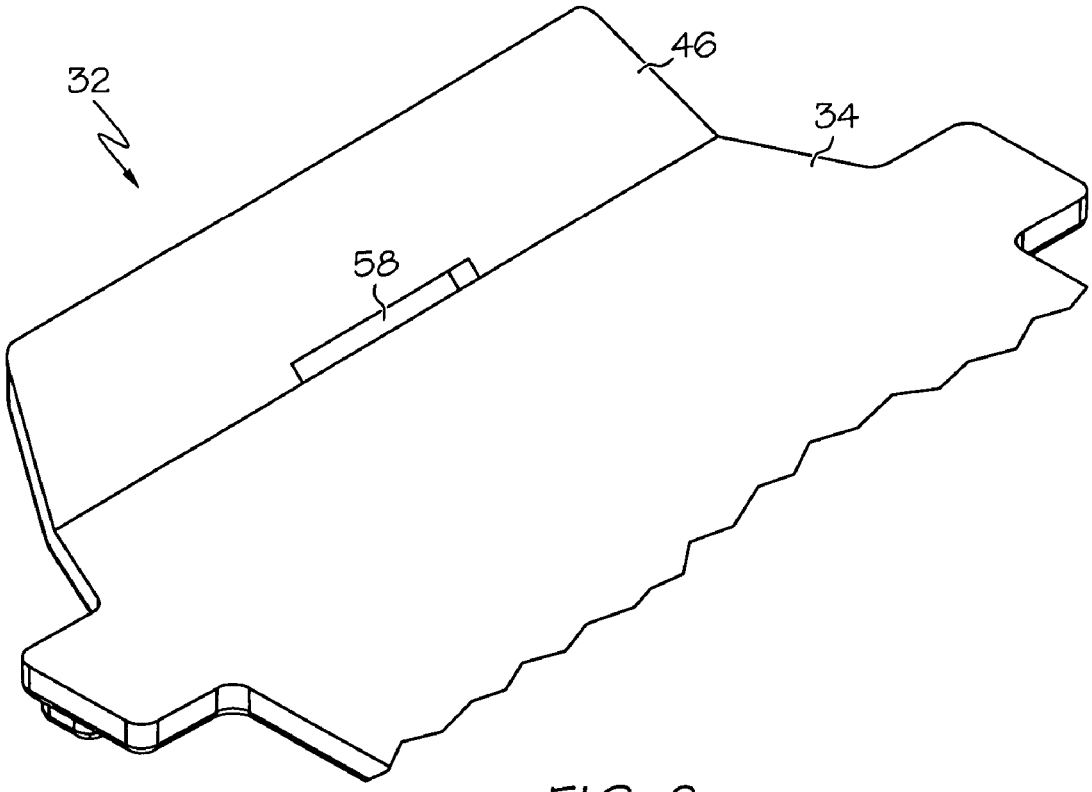
FIG. 8 is a fragmentary bottom view of the rail pad in the direction toward an end edge of the pad.

An embodiment of rail pad 32 is shown in FIGS. 2 through 7. FIG. 2 is a top perspective view, FIG. 3 is a top plan view, FIG. 4 is a bottom plan view, FIG. 5 is a longitudinal cross-sectional view, FIG. 6 is a side view, and FIG. 7 is an end view. As will be apparent from the drawing figures, rail pad 32 is a sheet-like component of generally rectangular form. Top surface 38 and bottom surface 34 are each substantially flat. Extending upwardly from top surface 38 are two pairs of laterally spaced projections 40 for positioning and retaining rail pad 32 in position relative to the outer edges of base flange 18 of rail 10. As shown, projections 40 are provided adjacent each of the longitudinal edges of rail pad 32, although they could be positioned further inwardly if desired, depending upon the width of rail pad 32 and the width of base flange 18.

Elongated recesses 42 and 44 are provided along the longitudinal edges of rail pad 32 to allow space for the positioning of the pad between insulators 24, 26 and between rail support members 14, 16 that are shown in FIG. 1. When clamp arms 20, 22 are in position, the arms, the insulators, and the rail support members serve to limit the lateral movement of rail 10 and of rail pad 32 relative to concrete tie 12. Should external loads that are applied to the rail pad attempt to move the pad laterally, the insulators and rail support members that are on either side of the rail and rail pad will restrain the extent of any such rail pad movement by virtue of their engagement with the edges of the elongated recesses 42, 44 of the rail pad.

It should be noted that some small clearance is intentionally provided between the edges of the elongated recesses 42, 44 of the rail pad and the restraining components of the installed assembly. The clearance allows the rail pad to freely locate itself between insulators 20, 22 and support members 14, 16 when it is positioned between the rail and the tie. That clearance is necessary to account for the slightly differing positions of rail support members 14, 16 because of manufacturing tolerances, or because of possible different positions of rail seat centerlines of adjacent ties that need to accommodate a continuous steel rail.

Rail pad 32 includes a pair of end edge panels 46, 48 that extend from respective opposite longitudinal ends of the rail pad. End edge panels 46, 48 are each inclined relative to pad top surface 38 and to pad bottom surface 34, and they each slope in a downward direction relative to pad top surface 38, as best seen in FIG. 5. End edge panels 46, 48 each include several spaced gussets 50 on their upwardly-facing surfaces for reinforcement of the end edge panels in order to maintain the preferred angular orientation relative to top and bottom surfaces 38, 34. The downward slope of end edge panels 46, 48 is provided so that the lower faces of each of the end edge panels engage a respective, correspondingly-inclined chamfer that is formed along the upper longitudinal edges of concrete tie 12, as shown in FIGS. 1A and 1B.

The inclined end edge panels of rail pad 32, when in contact with the corresponding chamfered edges 12*d* and 12*e* of the concrete tie 12, serve to restrain movement of the rail pad in the longitudinal direction of the rail. Inclined end edge panels 46, 48 thereby serve to maintain rail pad 32 in position on tie 12 by preventing pad movement that could otherwise be induced as a result of cyclically-varying forces that are applied to the pad as trains move long rail 10, or by forces imposed on the pad by the thermal expansion or contraction of the steel rail because of changing environmental conditions. In that regard, the disclosed design helps combat the longstanding problem of insufficient longitudinal restraint of the steel rail. Is is a strongly held belief that a major contributor to low longitudinal restraint of the steel rail was the poor longitudinal restraint of the underlying rail pad. By design, the disclosed assembly offers firm, positive, and reliable mechanical restraints to any imposed movement of the pad in the longitudinal direction of the rail, and arguably provides valued additional longitudinal restraint of the steel rail.

Rail pad top surface 38 can also include several parallel, laterally-extending surface depressions 52 for providing further resilience to train-imposed compressive forces, and also to reduce the amount of material that is needed to mold a rail pad. Other top surface depressions such as those shown in FIGS. 3 and 4 can also be included to further reduce pad weight and reduce raw material usage, and thereby cost. Additionally, outer lateral end edge panels 46, 48 of rail pad 32 can be trapezoidally-shaped, as shown, also to further reduce the amount of material that is needed to form the pad.

Bottom surface 34 of rail pad 32 is shown in FIG. 4. As shown, bottom surface 34 includes a substantially centrally-positioned depression 54. Depression 54 can be of annular form, as shown, or it can have a different geometrical form. In that regard, depression 54 is optional, and, as will hereinafter be explained, it can serve as a recess to receive adhesive for more secure positioning of abrasion plate 36 on tie 12.

As shown in FIGS. 4 and 7, rail pad 32 includes a pair of narrow, elongated slots 56, 58 in end edge panels 48, 46, respectively. In the form as shown, slots 56, 58 are substantially elongated rectangular openings that are centrally positioned along end edge panels 48, 46, to extend over and across the longitudinal centerline of rail pad 32. Slots 56, 58 are adjacent to pad bottom surface 34 to extend into and through respective end edge panels 48, 46, as shown in FIG. 7. Each of slots 56, 58 has a length in the transverse direction of rail pad 32 that is considerably smaller than the transverse dimension of respective end edge panels 48, 46.

Figure 9:
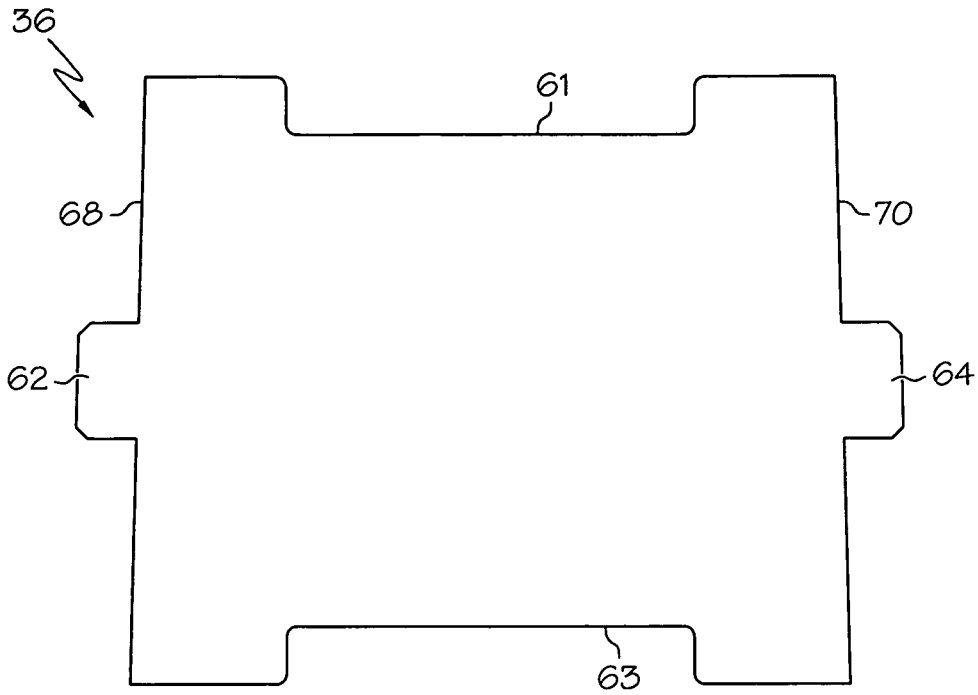
FIG. 9 is a top view of one form of abrasion plate adapted for use with the rail pad of FIG. 2 and having a single, central connection tab at each end.

One form of abrasion plate is shown in a top plan view in FIG. 9. Abrasion plate 36 is a thin, flat sheet of abrasion-resistant material. The bottom face that is not shown is the mirror image of the top face 60 that is shown in FIG. 9. Abrasion plate 36 is of substantially rectangular form and includes a pair of opposed, outwardly-extending connection tabs 62, 64 that extend outwardly from respective opposite end edges 66, 68. Abrasion plate 36 of FIG. 9 is adapted for use in conjunction with rail pad 32 shown in FIGS. 2 through 8, which includes opposed slots 56, 58.

Connection tabs 62, 64 of abrasion plate 36 have a thickness that corresponds substantially to the height of slots 56, 58 of rail pad 32, with a minimal clearance, not to exceed about 0.005 inches. Connection tabs 62, 64 have a designed width that is slightly narrower that the widths of respective slots 56, 58 in pad 32. That clearance is required to facilitate assembly of abrasion plate 36 to rail pad 32, and to allow rail pad 32 and abrasion plate 36 to assume their proper relative positions upon installation on a concrete tie. The clearance also allows the rail pad to move laterally a limited distance over the contacting abrasion plate surface in response to rail traffic loads, without causing movement of the abrasion plate relative to the concrete tie. It is preferable for such limited relative movements to take place between the rail pad and the abrasion plate in order to avoid any sliding movement of the abrasion plate relative to the concrete tie upper surface, because it is such sliding movement that causes abrasion of the concrete tie upper surface.

Similar to recesses 42 and 44 of rail pad 32, recesses 61 and 63 are provided along the longitudinal edges of abrasion plate 36. The abrasion plate recesses allow space for the positioning of the plate between rail support members 14, 16 as shown in FIG. 1. When clamp arms 20, 22, rail pad 32, and insulators 22, 26 are in position, those components combine with rail support members 14, 16 to eliminate any vertical movement of the abrasion plate off the concrete tie. History had shown, however, that those clamping and support components cannot reliably eliminate the possible lateral movement of the abrasion plate from beneath the rail pad when they are subjected to the cyclical loads imposed upon the assembly when it is in use. Given the relatively small thickness of the abrasion plate when viewed in cross section, along with the natural flexibility of most abrasion plate materials, it has been shown that working loads can cause an unrestrained abrasion plate to slip sideways relative to the rail pad. The plate can shift sideways until the edge of the plate contacts a rail support member, whereupon continued plate movement will cause the plate edge region to flex and then to move upward along the rail support member and away from the concrete tie surface. In the present design, on the other hand, any movement of the abrasion plate in the lateral direction is limited to the clearance provided between the widths of abrasion plate connection tabs 62, 64, and the designed widths of rail pad slots 56, 58. The described tab-in-slot design of the present invention helps assure that the abrasion plate will remain properly positioned beneath the rail pad, thereby providing the desired protection of the concrete tie surface.

In addition to restricting the movement of the abrasion plate, the disclosed embodiments also provide means to restrict any excessive and unwanted longitudinal movement of the abrasion plate when experiencing the cyclical loads during use of the assembly. By locating the abrasion plate beneath rail pad lower surface 34 and between inclined end edge panels 46, 48 of the rail pad, movement of the abrasion plate in the longitudinal direction is effectively limited. The allowable longitudinal movement of the abrasion plate is a function of the difference between the longitudinal length of the bottom surface of rail pad 32 that extends between the intersection of that bottom surface with inclined end edge panels 46, 48 and the distance between end edges 68, 70 of abrasion plate 36.

Figure 10:
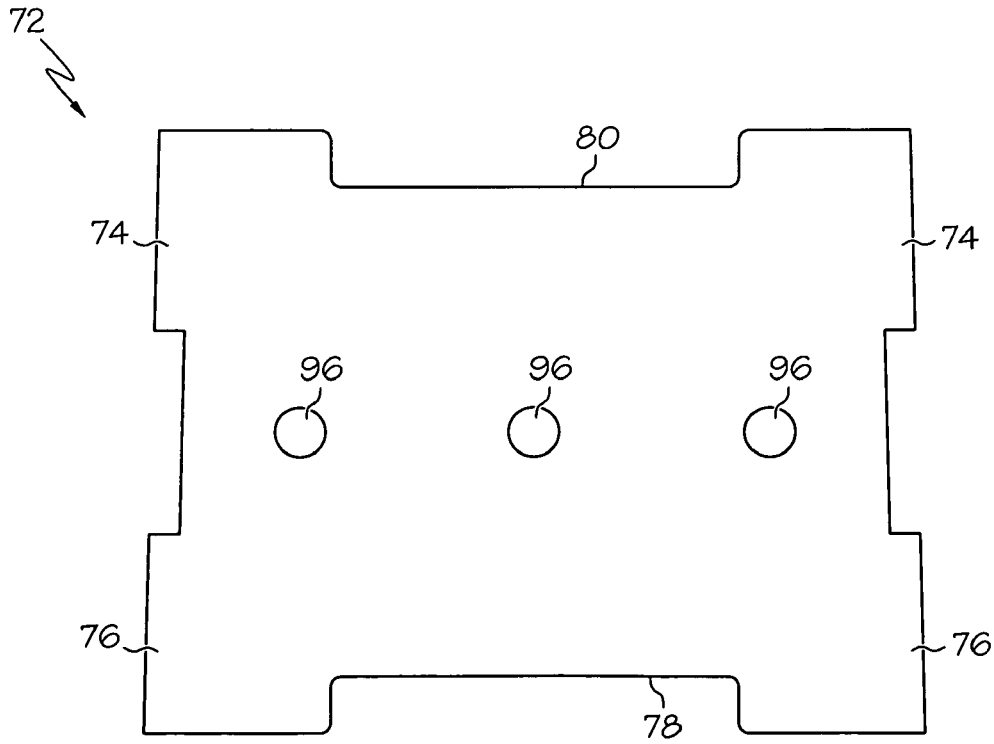
FIG. 10 is a top view of an embodiment of an abrasion plate having a pair of spaced connection tabs at each end.

Another form of abrasion plate is shown in FIG. 10. Abrasion plate 72 includes two substantially rectangular connection tabs 74, 76 at each of opposite end edges 78 and 80, respectively. The connection tabs at each end edge are spaced from each other and are received in respective spaced, substantially rectangular slots 82, 84 formed in rail pad 86 shown in FIG. 11. Connection tabs 74, 76 of abrasion plate 72 each have a thickness that corresponds substantially to the height of respective slots 82, 84 of rail pad 86, with the minimal clearance, not to exceed about 0.005 inches. Slots 82, 84 adjacent each longitudinal end of rail pad 86 have a spacing from each other and a respective width that corresponds to those of connection tabs 74, 76, to allow rail pad 86 some lateral movement relative to abrasion plate 72 in response to rail traffic loads, without causing movement of abrasion plate 72 relative to the concrete tie.

Figure 11:
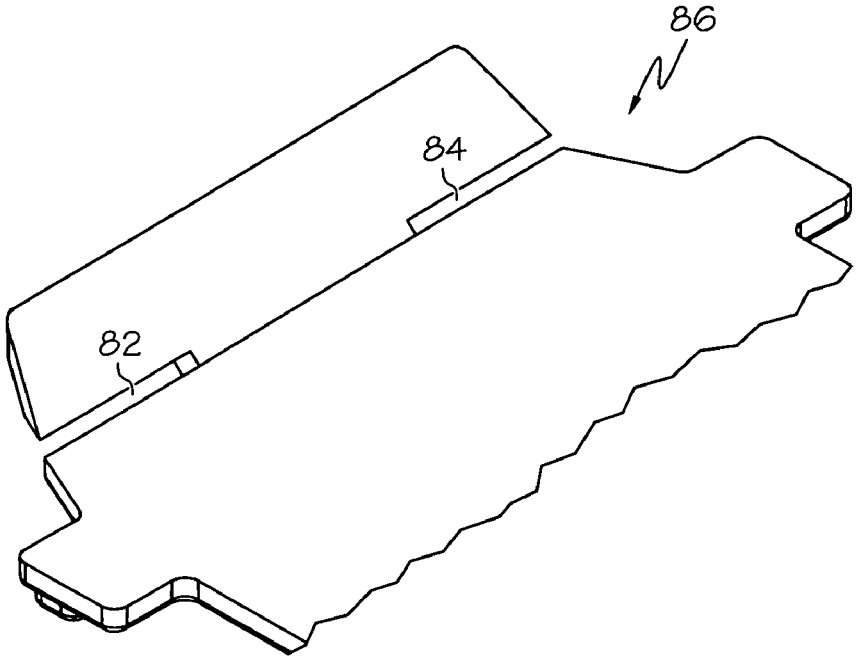
FIG. 11 is a fragmentary bottom view of a rail pad adapted for use in connection with the abrasion plate shown in FIG. 10.
Figure 12:
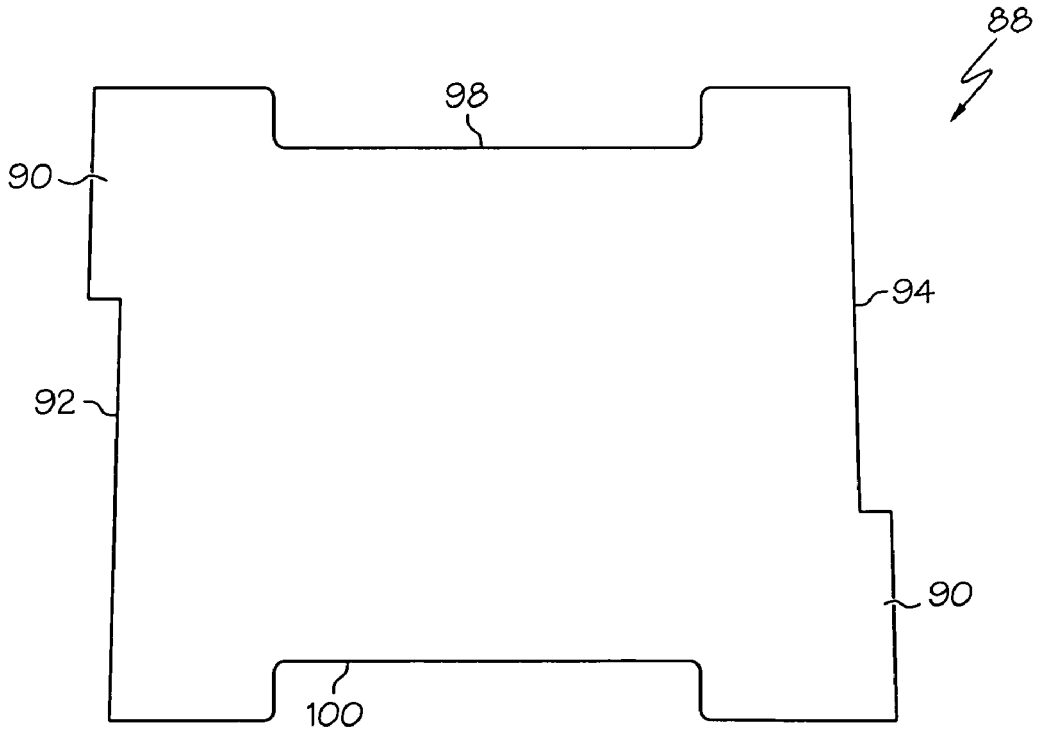
FIG. 12 is a top view of another embodiment of an abrasion plate adapted for use in connection with the rail pad shown in FIG. 11 and having single connection tabs at each end that are laterally offset from each other.

Rail pad 86 of FIG. 11 can also receive an abrasion pad 88 having the form shown in FIG. 12. Abrasion pad 88 has only two end connection tabs 90, one on each of a pair of opposite end edges 92, 94. Connection tabs 90 are laterally offset from each other, relative to the abrasion plate longitudinal axis, and are provided adjacent diagonally opposite corners of abrasion pad 88 so they can be received in corresponding slots that are positioned adjacent opposite corners of rail pad 86.

The abrasion plates shown in FIGS. 10 and 12, which have non-centrally-positioned connection tabs, can be less costly to produce in that they result in less waste of abrasion pad material because of the connection tab positions and the resulting ability to more closely position abrasion pad outlines on a large sheet of abrasion pad material. In a similar manner, abrasion plate 36 shown in FIG. 9 can be cut from a sheet of abrasion pad material in which individual abrasion pads are laterally offset from each other so that the connection tabs of adjacent abrasion pads are close and are next to each other rather than placed end-to-end.

In response to the excessive surface abrasion that has been experienced heretofore when concrete ties are utilized in place of wooden ties, the rail industry has developed a means by which those abraded areas of the concrete tie below the rails can be reconditioned. Various filler materials are available that when applied to the worn surfaces of concrete ties replaces the concrete material that has been abraded away. One such material is manufactured by the Willamette Valley Company, of Eugene, Oreg., and is sold under the trade name CTR. Such filler materials can also serve as bonding agents and are typically either epoxy- or urethane-based. When first applied to the tie these filler materials are of semi-liquid or paste-like consistency, they have high adhesive qualities, and they become extremely hard when fully cured.

It is common practice when servicing a worn concrete tie to first remove rail clips, insulators, steel rail, and rail pad assemblies to fully expose the worn surface of the tie. Repair compound is then deposited on the tie surface at the abraded areas, followed immediately by the placement of new rail pad assemblies over the repair compound. Some vertical force on the rail pad assembly is then required to firmly press the filler material down into the worn or abraded surfaces of the tie and to cause the repair material to flow into all available cavities. Once the repair material is fully cured, the repair effort results in the restoration of a planar surface at the previously-abraded tie upper surface, as well as to return the rail cushion assembly to its original elevation.

When utilized in association with a concrete tie repair process such as that described above, in which other forms of rail pad assemblies had been utilized, the rail cushion assembly disclosed herein can provide a two-part rail pad assembly that serves as added protection to the underlying concrete tie and filler material. It does so by limiting relative movements at the tie upper surface that could cause the concrete surface to abrade away beneath the rail. That added protection can be provided by forming multiple holes through the thickness of the abrasion plate, as shown in FIG. 10, to allow for the flow into and inclusion within the holes of the concrete tie filler material. Once fully cured, the filler material in the provided holes will act as a dowel pin, to eliminate or minimize possible lateral or longitudinal movement of the abrasion plate relative to the tie upper surface. By eliminating relative movement between the contacting abrasion plate and tie surfaces, abrasion of the tie surfaces can be avoided.

Abrasion plate 72 of FIG. 10 includes a series of three substantially equally-sized, spaced circular openings 96 positioned along its longitudinal centerline. At least one opening, such as the center opening, is positioned to underlie at least a portion of annular depression 54, shown in FIGS. 4 and 5 as a recess formed in rail pad lower surface 34. The center portion 54*a* of annular depression 54 is recessed a slight distance inwardly of and relative to pad lower surface 34 to define a cavity for receiving concrete tie repair material. In practice, downward pressure is applied to the rail pad, to force it toward the tie upper surface. As a result, the repair material flows from between the tie surface and the abrasion plate, through the opening of the abrasion plate, into the cavity formed between recessed center portion 54*a* and the upper surface of abrasion plate 72 that surrounds the center opening, and then extends laterally to form a cap or rivet-head-like form of the repair material against the upper surface of the abrasion plate. The thus-formed rivet-head-like formation assures that the abrasion plate will remain in a vertically fixed position relative to the concrete tie upper surface. As previously noted, abrasion plate 72 would be fixed both horizontally and rotationally relative to the tie upper surface by the dowel-pin-like elements formed by the repair material deposited within openings 96.

Rail pad 32 and abrasion plate 36, in their several geometrical variations as described above and as shown in the several drawing figures, can advantageously be connected together before shipment to a job site by means of the connection tab and slot arrangement disclosed herein. The assembly of an abrasion plate to a rail pad by inserting the abrasion pad connection tabs into the respective slots formed in the rail pad simplifies field installation of the rail cushion assembly by eliminating the shipping of separate components and an on-site assembly step.

The rail pads can be formed from a variety of materials that are suitable for providing flexible, long-lasting resilient pads. Suitable rail pad materials include specific grades of polyurethane, such as Elastollan®, available from BASF Corporation, of Florham Park, N.J. The abrasion plates can advantageously be formed from a tough, abrasion-resistant polymeric material, such as ultrahigh molecular weight polyethylene sheets having a thickness of from about 0.040 to about 0.090 inches.

The rail cushion assembly disclosed herein provides a two-part rail pad assembly that serves to protect the underlying concrete tie. It does so by limiting movements at the tie upper surface that could cause the surface to abrade away beneath the rail. When utilized in association with a concrete tie repair process such as that described above, additional protection can be provided by the design by forming multiple holes through the thickness of the abrasion plate to allow for the flow and inclusion of the concrete tie repair material. Once fully cured, the repair material occupying the provided holes will act as a dowel pin to completely eliminate any possible lateral or longitudinal movement of the abrasion plate relative to the tie upper surface. By eliminating relative movement between the contacting abrasion plate and tie surfaces, abrasion of the tie surfaces can be avoided.

Although particular embodiments of the present invention have been illustrated and described, it will be apparent to those skilled in the art that changes and modifications can be made without departing from the spirit of the present invention. For example, although shown as passing completely through end edge panels 48, 46, the slots in rail pad 32 need not extend through the end edge panels, but can instead extend only partially into the end edge panels, if desired. Accordingly, it is intended to encompass within the appended claims all such changes and modifications that fall with the scope of the present invention.

What is claimed is:

1. A rail cushion assembly for placement between a lower surface of a railroad rail and an upper surface of a railroad tie, said rail cushion assembly comprising:

a. a resilient rail pad having a substantially flat upper surface adapted to face and to contact a railroad rail lower surface, and a substantially flat lower surface adapted to face a railroad tie upper surface, wherein the rail pad includes a pair of opposed, railroad-tie-engaging inclined end edge panels extending from a pair of opposite ends of the rail pad, and at least one slot adjacent an intersection between the inclined end edge panels and a bottom surface of the rail pad; and b. a flat, flexible abrasion plate releaseably carried by the rail pad and adjacent the lower surface of the rail pad, the abrasion plate including at least one laterally-extending connection tab on each of two opposite edge surfaces, wherein each of the at least one connection tabs is releaseably received in a respective slot of the rail pad.

2. A rail cushion assembly in accordance with claim 1, wherein the rail pad is substantially rectangular.

3. A rail cushion assembly in accordance with claim 1, wherein the abrasion plate is substantially rectangular.

4. A rail cushion assembly in accordance with claim 1, wherein the abrasion plate is a flat sheet of abrasion-resistant material.

5. A rail cushion assembly in accordance with claim 1, wherein the tabs include a pair of laterally-spaced, outwardly-extending connection tabs at each of the pair of opposite edge surfaces, and the slots include a pair of correspondingly shaped and correspondingly-positioned slots at each of said pair of opposite end edge panels for receiving respective connection tabs of the abrasion plate.

6. A rail cushion assembly in accordance with claim 1, wherein the tabs include a connection tab at each of the pair of opposite edge surfaces, and wherein the connection tabs are laterally offset from each other, relative to an abrasion plate longitudinal centerline.

7. A rail cushion assembly in accordance with claim 1, wherein the abrasion plate is in the form of a flat sheet of ultra high molecular weight polyethylene.

8. A rail cushion assembly in accordance with claim 1, wherein the abrasion plate has a thickness of from about 0.040 in. to about 0.090 in.

9. A rail cushion assembly in accordance with claim 1, wherein the rail pad includes a recess on a bottom surface for receiving a bonding agent for bonding together the rail pad and the abrasion plate.

10. A rail cushion assembly in accordance with claim 9, wherein the abrasion plate includes at least one opening that communicates with the recess to allow bonding agent to flow from the recess, between the rail pad and the abrasion plate, and through the opening when pressure is applied to the rail cushion assembly as it is placed in operative position on a railroad tie.

11. A rail cushion assembly in accordance with claim 10, wherein the recess is larger than the at least one opening, so that cured bonding agent forms a rivet-head-like formation to hold the abrasion plate relative to the rail pad.

12. A rail cushion assembly in accordance with claim 9, wherein the abrasion plate includes at least one opening that communicates with the recess, so that cured bonding agent forms a dowel to limit movement of the abrasion plate relative to the tie when the rail cushion assembly is placed in operative position on a railroad tie.

* * * * *